US010775730B2

(12) United States Patent
Nakagawa

(10) Patent No.: US 10,775,730 B2
(45) Date of Patent: Sep. 15, 2020

(54) SHEET FEEDING APPARATUS AND IMAGE FORMING APPARATUS

(71) Applicant: CANON KABUSHIKI KAISHA, Tokyo (JP)

(72) Inventor: Hiroyuki Nakagawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 16/108,112

(22) Filed: Aug. 22, 2018

(65) Prior Publication Data

US 2019/0064723 A1 Feb. 28, 2019

(30) Foreign Application Priority Data

Aug. 29, 2017 (JP) ..... 2017-164718

(51) Int. Cl.
*G03G 15/00* (2006.01)

(52) U.S. Cl.
CPC ..... *G03G 15/607* (2013.01); *G03G 15/5029* (2013.01); *G03G 15/602* (2013.01); *G03G 15/6511* (2013.01); *G03G 15/6514* (2013.01); *G03G 15/6555* (2013.01)

(58) Field of Classification Search
CPC ..... G03G 15/6511
USPC ..... 399/392
See application file for complete search history.

(56) References Cited

U.S. PATENT DOCUMENTS

| | | | | |
|---|---|---|---|---|
| 7,383,015 | B2 * | 6/2008 | Sato | G03G 15/6502 399/392 |
| 9,944,479 | B2 * | 4/2018 | Nakagawa | B65H 1/266 |
| 10,053,312 | B2 | 8/2018 | Nakagawa | |
| 2008/0226358 | A1 * | 9/2008 | Hanashima | G03G 15/161 399/299 |
| 2017/0066608 | A1 * | 3/2017 | Kondo | B65H 3/0684 |
| 2017/0066610 | A1 * | 3/2017 | Kai | B65H 5/062 |
| 2017/0283194 | A1 * | 10/2017 | Nakagawa | G03G 15/6514 |
| 2019/0041787 | A1 | 2/2019 | Murata | |

FOREIGN PATENT DOCUMENTS

| | | | |
|---|---|---|---|
| JP | 2007-031093 | A | 2/2007 |
| JP | 2010-013276 | A | 1/2010 |

* cited by examiner

*Primary Examiner* — Anthony H Nguyen
(74) *Attorney, Agent, or Firm* — Venable LLP

(57) ABSTRACT

A sheet feeding apparatus, includes a moving portion configured to move one of a feeding portion and a stacking portion to switch between a contact state in which the feeding portion is in contact with a sheet on the stacking portion and a separation state in which the feeding portion is separated from the sheet; and a controller configured to control the moving portion to bring the feeding portion into the contact state at a time of start of a sheet feed job. The controller executes a first mode of controlling the moving portion to bring the feeding portion into the separation state, and executes a second mode of controlling the moving portion to maintain the feeding portion in the contact state when a sheet detector detects a sheet on the stacking portion after end of feeding of a final sheet in the sheet feed job.

10 Claims, 10 Drawing Sheets

SHEET FEEDING APPARATUS AND IMAGE FORMING APPARATUS

BACKGROUND OF THE INVENTION

Field of the Invention

The present invention relates to a sheet feeding apparatus configured to feed sheets and an image forming apparatus.

Description of the Related Art

In general, an image forming apparatus such as a printer can feed sheets of a plurality of sizes. The image forming apparatus is configured to receive sheets of standard sizes such as A4 and B5 in cassettes and to place a sheet, which is long in a conveying direction (hereinafter referred to as "long sheet"), on a manual feed tray.

Hitherto, there has been proposed an image forming apparatus including the following manual feed tray (Japanese Patent Application Laid-Open No. 2007-031093). Specifically, the manual feed tray includes a first retaining portion and a second retaining portion. The first retaining portion is configured to retain a front part of the long sheet. The second retaining portion is configured to retain a rear part of the long sheet. A guide portion configured to determine a posture of an intermediate part of the long sheet is formed integrally with the first retaining portion. The long sheet is received in an upwardly curled posture by the first retaining portion, the second retaining portion, and the guide portion. Therefore, the image forming apparatus can be made compact. However, due to influence of a reaction force generated by the curl of the long sheet and a self-weight of the long sheet, a force of pressing the long sheet into a feed roller pair (hereinafter referred to as "press-in force") is exerted on a leading end of the long sheet. When the press-in force is large, the leading end of the long sheet undesirably passes beyond a nip of the feed roller pair, which may cause a feeding failure. In view of the disadvantage described above, there has been proposed the following image forming apparatus (Japanese Patent Application Laid-Open No. 2010-013276). Specifically, in the image forming apparatus, a first retaining member configured to retain the front part of the long sheet has a recessed portion. The long sheet is curved downward in the recessed portion so as to reduce the press-in force.

However, in particular, when the long sheet has a large stiffness, the image forming apparatus described in Japanese Patent Application Laid-Open No. 2010-013276 cannot sufficiently reduce the press-in force because the long sheet is substantially not curved in the recessed portion. Thus, a feeding failure may be caused.

SUMMARY OF THE INVENTION

According to one embodiment of the present invention, there is provided a sheet feeding apparatus, comprising:

a stacking portion on which sheets are stacked;

a feeding portion configured to feed the sheets stacked on the stacking portion;

a separation portion configured to separate one by one the sheets fed by the feeding portion;

a sheet detector configured to detect the sheets stacked on the stacking portion;

a moving portion configured to move one of the feeding portion and the stacking portion relative to the other of the feeding portion and the stacking portion so as to bring the feeding portion into a contact state in which the feeding portion is in contact with an uppermost sheet of the sheets stacked on the stacking portion and a separation state in which the feeding portion is separated from the sheets stacked on the stacking portion; and a controller configured to control the moving portion so as to bring the feeding portion into the contact state at a time of start of a sheet feed job for feeding the sheets, wherein the controller is configured to execute control in a first mode in which the controller controls the moving portion so as to bring the feeding portion into the separation state regardless of whether the sheet detector detects a sheet after end of feeding of a final sheet in the sheet feed job, and execute control in a second mode in which the controller controls the moving portion so as to maintain the feeding portion in the contact state when the sheet detector detects a sheet after the end of feeding of the final sheet in the sheet feed job.

According to another embodiment of the present invention, there is provided a sheet feeding apparatus, comprising:

a stacking portion on which sheets are stacked;

a feeding portion configured to feed the sheets stacked on the stacking portion;

a separation portion configured to separate one by one the sheets fed by the feeding portion;

a sheet detector configured to detect the sheets stacked on the stacking portion;

a moving portion configured to move one of the feeding portion and the stacking portion relative to the other of the feeding portion and the stacking portion so as to bring the feeding portion into a contact state in which the feeding portion is in contact with an uppermost sheet of the sheets stacked on the stacking portion and a separation state in which the feeding portion is separated from the sheets stacked on the stacking portion; and a controller configured to control the moving portion so as to bring the feeding portion into the contact state at a time of start of a sheet feed job for feeding the sheets, wherein the controller is configured to control the moving portion so as to maintain the feeding portion in the contact state when the sheet detector detects a sheet after end of feeding of a final sheet in the sheet feed job.

Further features of the present invention will become apparent from the following description of exemplary embodiments with reference to the attached drawings.

DESCRIPTION OF THE EMBODIMENTS

First Embodiment

Now, a first embodiment will be described with reference to the accompanying drawings. In the following description, positional relationships including a vertical positional relationship, a horizontal positional relationship, and a positional relationship between a near side and a far side will be described based on a state in which an image forming apparatus is viewed from a front side thereof (from a point of view of FIG. 1).

[Image Forming Apparatus]

Figure 1:
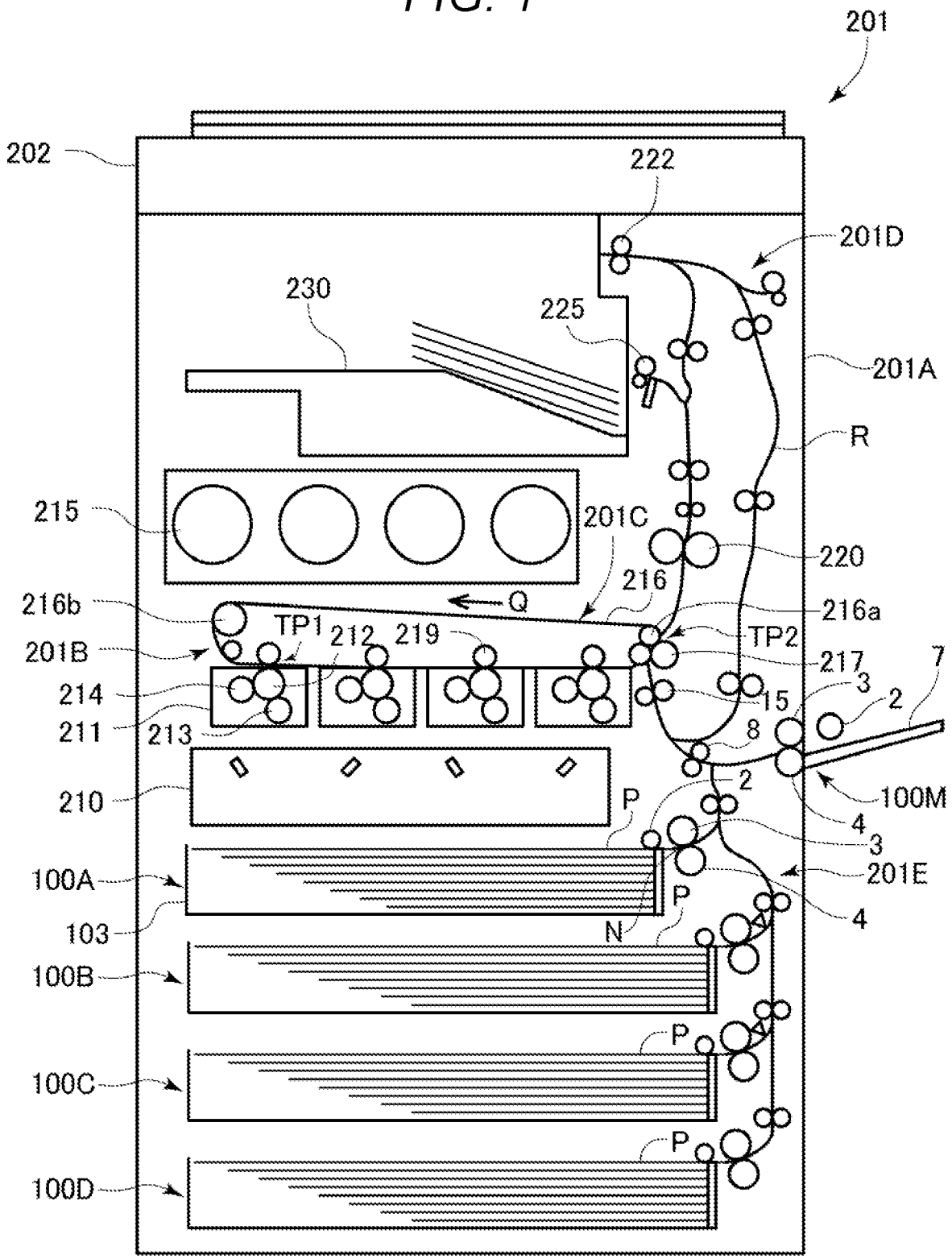
FIG. 1 is an overall schematic view for illustrating a printer according to a first embodiment.

A printer 201 according to the first embodiment is an electrophotographic full-color laser beam printer. As illustrated in FIG. 1, the printer 201 includes a printer main body 201A and a reading apparatus 202. The printer main body 201A is a main body. The reading apparatus 202 is provided above the printer main body 201A and is configured to read image data of an original.

The printer main body 201A includes an image forming portion 201B, which is configured to form an image on a sheet P, and a fixing portion 220, which is configured to fix the image onto the sheet P. A delivery space into which the sheet P is delivered is formed between the reading apparatus 202 and the printer main body 201A. In the delivery space, a delivery tray 230, on which the delivered sheet P is stacked, is provided. Further, a sheet feeding portion 201E, which is configured to feed the sheet P to the image forming portion 201B, is provided in the printer main body 201A. The sheet feeding portion 201E includes cassette feeding devices 100A, 100B, 100C, and 100D, and a manual feeding device 100M. The cassette feeding devices 100A, 100B, 100C, and 100D are arranged in a lower part of the printer main body 201A to contain sheets Pin cassettes 103, respectively. The manual feeding device 100M is arranged in a right side portion of the printer main body 201A. Each of the cassette feeding devices 100A, 100B, 100C, and 100D, and the manual feeding device 100M includes a pickup roller 2, a feed roller 3, and a retard roller 4. The pickup roller 2 is configured to feed the sheet P. The feed roller 3 and the retard roller 4 are configured to convey the sheet P while separating the sheets P one by one.

The image forming portion 201B is a so-called four-drum full-color type image forming portion including a laser scanner 210, four process cartridges 211, and an intermediate transfer unit 201C. The respective process cartridges 211 form toner images of yellow (Y), magenta (M), cyan (C), and black (B). Each of the process cartridges 211 includes a photosensitive drum 212, a charger 213, a developing device 214, and a cleaner (not shown). Above the image forming portion 201B, toner cartridges 215, which contain toners of the respective colors, are mounted in the printer main body 201A so as to be freely removable from the printer main body 201A.

The intermediate transfer unit 201C includes an intermediate transfer belt 216, which is looped over a drive roller 216*a*, a tension roller 216*b*, and the like. The intermediate transfer belt 216 is arranged above the four process cartridges 211. The intermediate transfer belt 216 is arranged so as to be held in contact with the photosensitive drums 212 of the respective process cartridges 211, and is rotated in a counterclockwise direction (direction indicated by an arrow Q) by the drive roller 216*a*, which is driven by a drive portion (not shown). The intermediate transfer unit 201C includes a primary transfer roller 219, which is held in abutment against an inner peripheral surface of the intermediate transfer belt 216 at positions opposed to the respective photosensitive drums 212. Primary transfer portions TP1 are formed as nip portions between the intermediate transfer belt 216 and the photosensitive drums 212. Further, the image forming portion 201B includes a secondary transfer roller 217, which is held in abutment against an outer peripheral surface of the intermediate transfer belt 216 at a position opposed to the drive roller 216*a*. A secondary transfer portion TP2, at which the toner images borne on the intermediate transfer belt 216 are transferred onto the sheet P, is formed as a nip portion between the secondary transfer roller 217 and the intermediate transfer belt 216.

In each of the process cartridges 211 having the configuration described above, an electrostatic latent image is formed on a surface of the photosensitive drum 212 by the laser scanner 210. Thereafter, a toner image of each of the colors, which is charged to have negative polarity, is formed by supplying a toner from the developing device 214. Through application of transfer bias voltages having positive polarity respectively to the primary transfer rollers 219, the toner images are sequentially multi-layer transferred onto the intermediate transfer belt 216 at the primary transfer portions TP1, thereby forming a full-color toner image on the intermediate transfer belt 216.

In parallel to the above-mentioned image formation process, the sheet P fed from the sheet feeding portion 201E is conveyed toward a registration roller pair 15. Skew feed of the sheet P is corrected by the registration roller pair 15. The registration roller pair 15 conveys the sheet P to the secondary transfer portion TP2 at timing in accordance with timing to transfer the full-color toner image formed on the intermediate transfer belt 216. The toner image borne on the intermediate transfer belt 216 is secondarily transferred onto the sheet P at the secondary transfer portion TP2 through application of a transfer bias voltage having positive polarity to the secondary transfer roller 217.

The sheet P onto which the toner image has been transferred is heated and pressurized at the fixing portion 220 so that the color image is fixed onto the sheet P. The sheet P onto which the image has been fixed is delivered by a delivery roller pair 225 to the delivery tray 230 to be stacked thereon. When images are formed on both sides of the sheet P, the sheet P first passes through the fixing portion 220. Then, the sheet P is switched back by a reverse roller pair 222, which is provided in a reverse conveying portion 201D and can be rotated in a forward direction and a reverse direction. Then, the sheet P is conveyed again to the secondary transfer portion TP2 through a re-conveyance path R, and the image is formed on a back surface of the sheet P.

[Manual Feeding Device]

Figure 2:
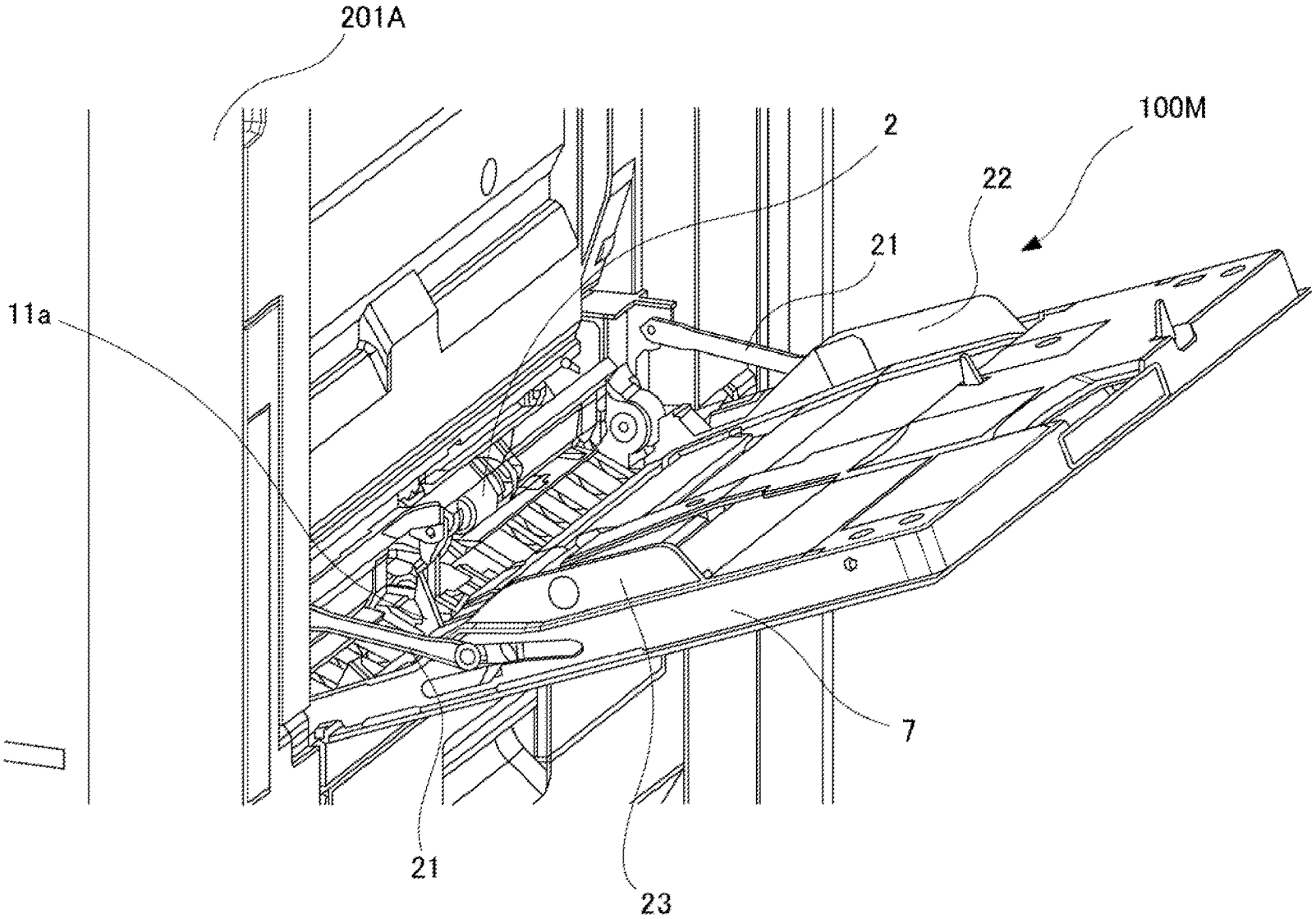
FIG. 2 is a perspective view for illustrating a manual feeding device.
Figure 3:
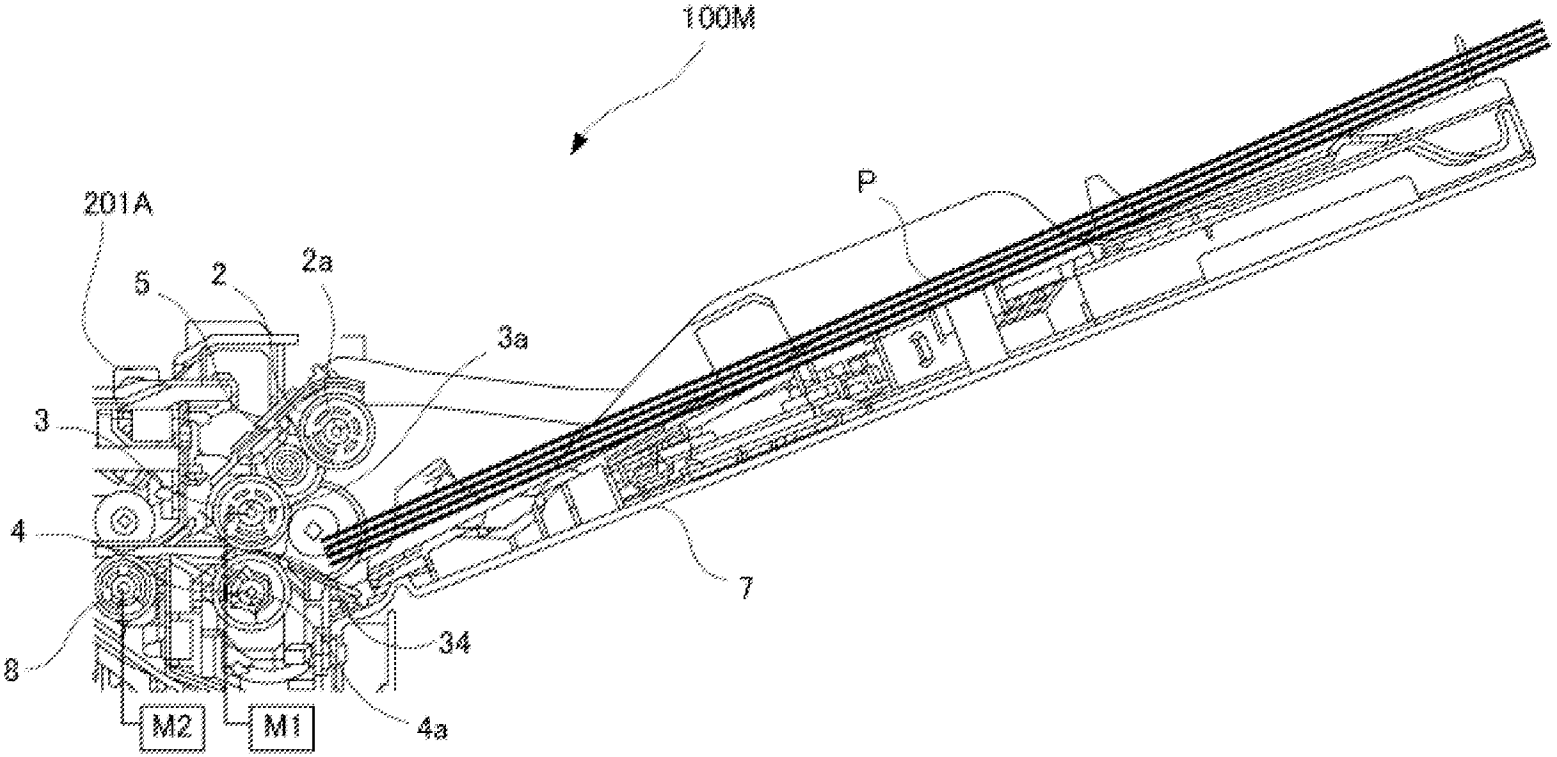
FIG. 3 is a side view for illustrating the manual feeding device.

With reference to FIG. 2 and FIG. 3, the manual feeding device 100M serving as a sheet feeding apparatus will be described. The manual feeding device 100M includes, as illustrated in FIG. 2 and FIG. 3, a manual feed tray 7, the pickup roller 2, the feed roller 3, and the retard roller 4.

The manual feed tray 7 is supported onto the printer main body 201A so as to be openable and closeable. An opening and closing angle of the manual feed tray 7 is regulated by tray arms 21. A pair of side regulating plates 22 and 23, which is movable in a width direction orthogonal to a sheet feed direction, is provided for the manual feed tray 7. The side regulating plates 22 and 23 interlock with each other so as to move in directions opposite to each other. The side regulating plates 22 and 23 are moved by a user to regulate positions of ends of the sheet placed on the manual feed tray 7 in the width direction.

A detection flag 11*a* (see FIG. 2) is supported on a downstream end portion of the manual feed tray 7 in the sheet feed direction so as to be pivotable. The detection flag 11*a* is retained at a protruding position at which the detection flag 11*a* protrudes upwardly from an upper surface of the manual feed tray 7. The detection flag 11*a* is pivoted by being pressed by the sheet to block an optical path of a sheet sensor 11 (see FIG. 4) which is configured to detect presence or absence of the sheet as a sheet detector formed of, for example, a photosensor. As a result, the sheet sensor 11 is turned on to detect the sheets stacked on the manual feed tray 7. When no sheet is left on the manual feed tray 7, the detection flag 11*a* returns to the protruding position to turn off the sheet sensor 11.

The feed roller 3 is rotatably supported on a rotary shaft 3*a* provided to the printer main body 201A. A feed arm 5 is supported on the rotary shaft 3*a* so as to be pivotable. The pickup roller 2 serving as a feeding portion is supported on a distal end of the feed arm 5 so as to be rotatable about a rotary shaft 2*a*.

A drive force is input from a feed motor M1 (see FIG. 4) to the rotary shaft 3*a* of the feed roller 3. The drive force of the feed motor M1 input to the rotary shaft 3*a* is transmitted to the pickup roller 2 through intermediation of a gear train (not shown) supported on the feed arm 5. The retard roller 4 is supported on a rotary shaft 4*a* through intermediation of a torque limiter (not shown) so as to be rotatable. The retard roller 4 is held in contact with the feed roller 3 with a predetermined contact pressure. A drive force is also input to the rotary shaft 4*a* of the retard roller 4 from the feed motor M1. The drive force in a direction opposite to the sheet feed direction, specifically, a direction of returning the sheet to the manual feed tray 7 is input to the retard roller 4. Further, the torque limiter (not shown) is provided between the retard roller 4 and the rotary shaft 4*a*.

The feed arm 5 is urged in a direction in which the pickup roller 2 is brought closer to the manual feed tray 7, specifically, a direction in which the pickup roller 2 is lowered, by, for example, a torsion coil spring (not shown) fitted into the rotary shaft 3*a* of the feed roller 3 by insertion. When the sheet is fed by the pickup roller 2, the feed motor M1 is rotated in a first rotating direction. When the feed motor M1 is rotated in a second rotating direction opposite to the first rotating direction, the feed arm 5 is raised. When the feed motor M1 is rotated in the first rotating direction, a coil portion of the torsion coil spring is loosened. Thus, the rotation of the rotary shaft 3*a* is not transmitted to the feed arm 5. Meanwhile, when the feed motor M1 is rotated in the second rotating direction, the coil portion of the torsion coil spring is tightened. As a result, the rotation of the rotary shaft 3*a* is transmitted to the feed arm 5 through intermediation of the torsion coil spring. Specifically, the torsion coil spring functions as a spring clutch.

By the drive of the feed motor M1 as described above, the feed arm 5 serving as a moving portion is raised and lowered so that a state of the pickup roller 2 is switched between a contact state in which the pickup roller 2 is held in contact with an uppermost sheet of the sheets stacked on the manual feed tray 7 and a separation state in which the pickup roller 2 is separated from the sheets stacked on the manual feed tray 7. The feed arm 5 may be configured so as to be raiseable by a cam and other components in place of the torsion coil spring. The feed arm 5 may be driven by a motor different from the feed motor M1 or by a solenoid.

At the start of a print job as a sheet feed job using the manual feeding device 100M as a feed source, the pickup roller 2 is lowered so as to be turned from the separation state into the contact state and is brought into contact with the sheet placed on the manual feed tray 7. The sheet placed on the manual feed tray 7 is fed by the pickup roller 2 toward a separation nip 34 serving as a separation portion formed by the feed roller 3 and the retard roller 4.

When only one sheet is fed to the separation nip 34 by the pickup roller 2, the torque limiter provided between the rotary shaft 4*a* and the retard roller 4 spins, and hence the retard roller 4 is dragged by the feed roller 3. Further, when two or more sheets are fed by the pickup roller 2, the retard roller 4 is rotated in a direction of returning back the sheet to the manual feed tray 7. As a result, the second and subsequent sheets are returned back to the manual feed tray 7. A drive force is not required to be input to the retard roller 4. Further, in place of the retard roller 4, a separation pad may be provided. The sheets separated one by one by the separation nip 34 are conveyed to the registration roller pair 15 (see FIG. 1) by a draw roller pair 8 driven by a draw motor M2.

[Control Block]

Figure 4:
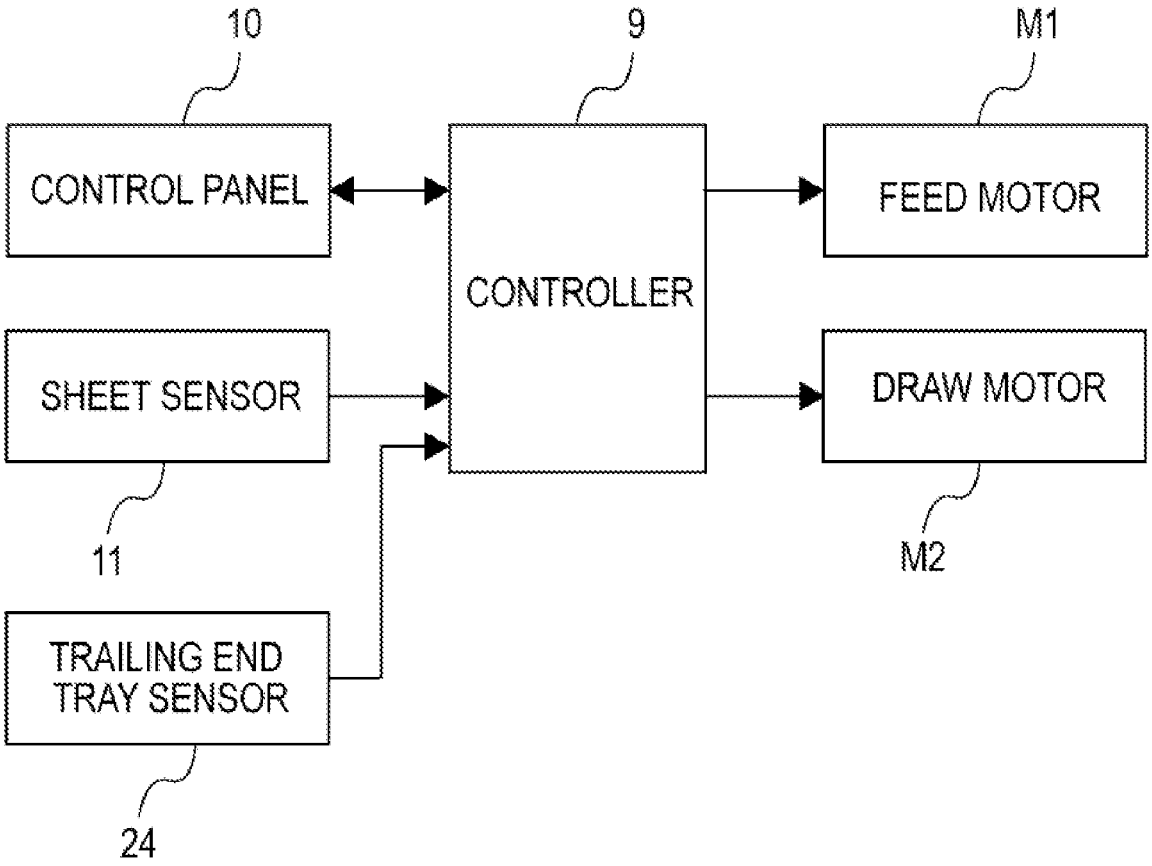
FIG. 4 is a control block diagram according to the first embodiment.

FIG. 4 is a control block diagram according to the first embodiment. A controller 9 includes a CPU (not shown), a ROM (not shown), a RAM (not shown), and other devices. A program stored in the ROM can be executed by the CPU. A control panel 10 is connected to the controller 9. The control panel 10 serving as an operating portion can perform various setting for the printer 201 and display a screen based on an output signal from the controller 9. The sheet sensor 11 and a trailing end tray sensor 24 described later are connected to an input side of the controller 9. The feed motor M1 and the draw motor M2 are connected to an output side of the controller 9.

The controller 9 may be provided in the manual feeding device 100M or may be provided at a location different from the manual feeding device 100M of the printer 210. When the controller 9 is provided in the manual feeding device 100M, the manual feeding device 100M corresponds to the sheet feeding apparatus. When the controller 9 is provided in the printer 201, the printer 201 corresponds to the sheet feeding apparatus.

[Placement of Long Sheet]

Next, with reference to FIG. 5, placement of a long sheet LP in the manual feeding device 100M will be described. Although the "long sheet LP" herein corresponds to a sheet, for example, having a length equal to or larger than 457 mm (18 inches) in a sheet conveying direction, the long sheet LP is not limited thereto.

The manual feeding device 100M includes a trailing end tray 14 and an intermediate guide 13. The trailing end tray 14 is mountable to and removable from the printer main body 201A. The intermediate guide 13 is mountable to and removable from a distal end of the manual feed tray 7. The manual feed tray 7 serving as a first tray, the intermediate guide 13, and the trailing end tray 14 serving as a second tray form a tray unit 12 serving as a stacking portion. The trailing end tray 14 is provided above the manual feed tray 7 so as to overlap the manual feed tray 7 as viewed in a vertical direction. A mounted state in which the trailing end tray 14 is mounted to the printer main body 201A and a non-mounted state in which the trailing end tray 14 is not mounted to the printer main body 201A are detected by a trailing end tray sensor 24 (see FIG. 4) serving as a tray detector. The intermediate guide 13 is formed so as to extend from a distal end of the manual feed tray 7 to an upstream side in the sheet feed direction and to be then bent upward. The manual feed tray 7 and the intermediate guide 13 may be formed integrally. In this case, for the placement of the long sheet LP, the user mounts a manual feed tray for the long sheet LP to the printer main body 201A.

After the placement of the long sheet LP in the manual feeding device 100M, the long sheet LP is guided so that a leading end is placed on the manual feed tray 7 and an intermediate portion is curved upward by the intermediate guide 13. A trailing end of the long sheet LP guided by the intermediate guide 13 is supported on the trailing end tray 14. As a weight of the long sheet LP, a part of the trailing end side is retained by the trailing end tray 14, and the remaining part is retained by the manual feed tray 7. Further, when the trailing end of the long sheet LP is brought into pressure contact with the printer main body 201A, a reaction force applied by curving the long sheet LP is exerted on the leading end side of the long sheet LP.

Under a state in which the leading end of the long sheet LP is held in abutment against the separation nip 34, a force of pressing the long sheet LP into the separation nip 34 (hereinafter referred to as "press-in force") is exerted on the leading end of the long sheet LP due to influence of a weight of the long sheet and the reaction force. When the press-in force becomes larger than a frictional resistance of the separation nip 34, the leading end of the long sheet LP may pass beyond the separation nip 34 to result in a feeding failure.

[First Mode]

Next, raising and lowering control of the pickup roller 2 performed after end of a print job (hereinafter referred to as "job end control") will be described. The controller 9 of the first embodiment executes the job end control in any one of a first mode and a second mode. First, the job end control in the first mode will be described.

Figure 6:
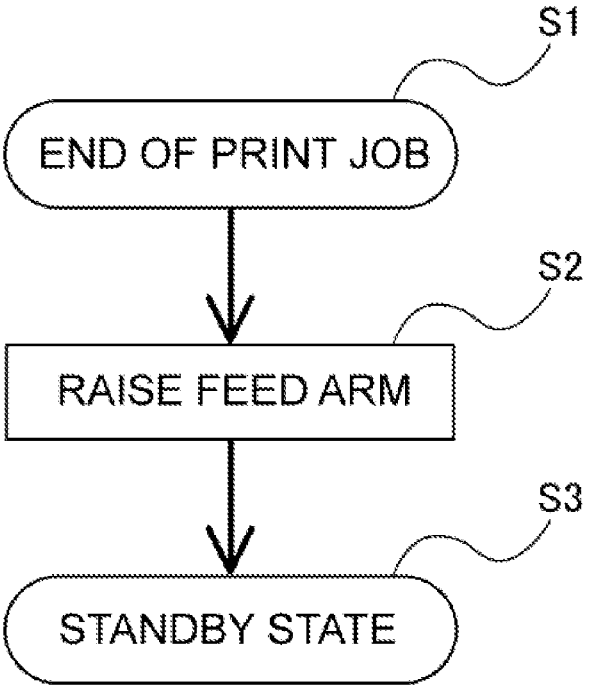
FIG. 6 is a flowchart for illustrating job end control executed in a first mode.

FIG. 6 is a flowchart for illustrating the job end control in the first mode. When the print job ends (Step S1), the controller 9 raises the feed arm 5 so that the pickup roller 2 is brought into the separation state (Step S2). Specifically, the controller 9 controls the feed arm 5 so that the pickup roller 2 is brought into the separation state regardless of whether or not the sheet sensor 11 has detected the sheet. Then, the controller 9 is brought into a standby state (Step S3).

By the job end control described above, the pickup roller 2 is reliably separated from the manual feed tray 7 after the end of the print job. Therefore, the sheet placed on the manual feed tray 7 can be easily removed, and the sheet can be easily placed on the manual feed tray 7.

Figure 5:
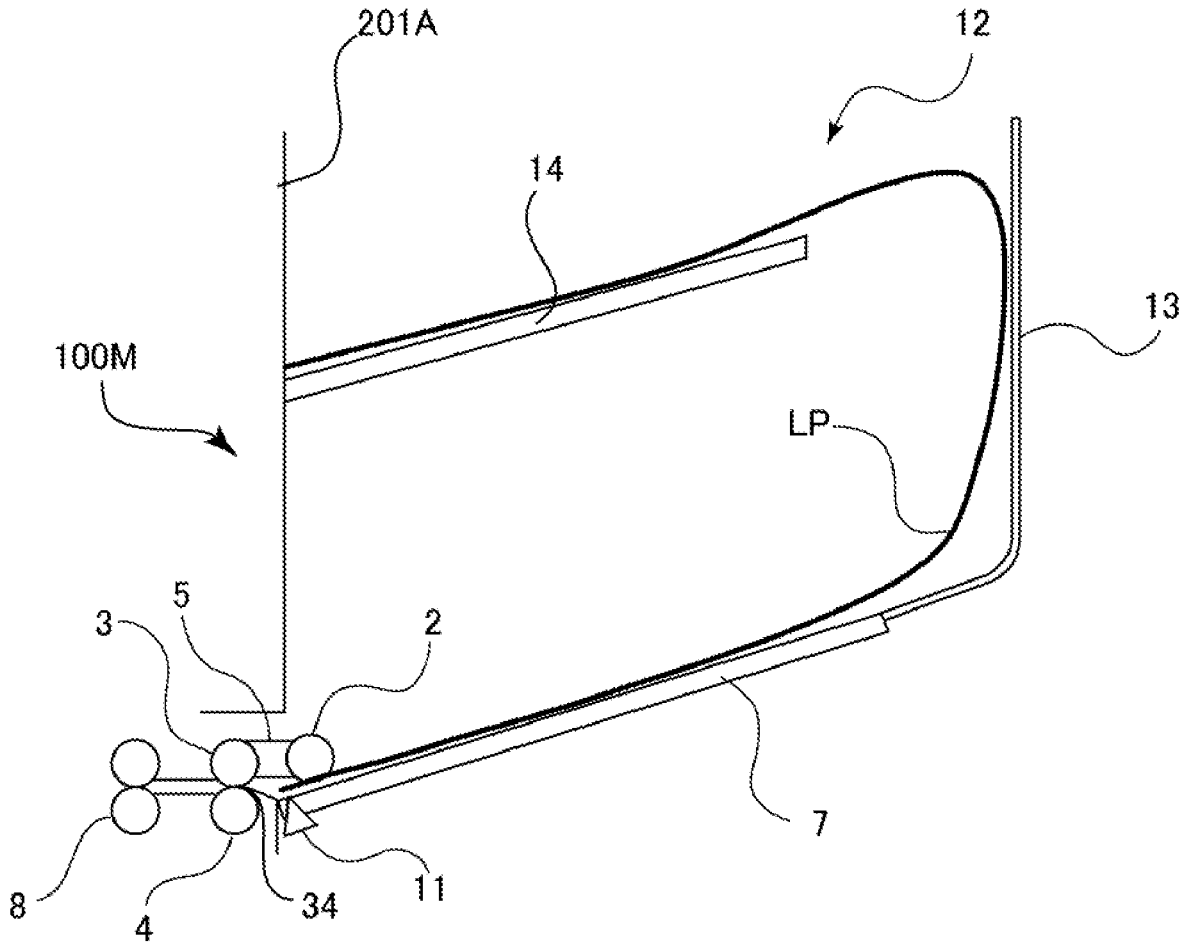
FIG. 5 is a side view for illustrating a configuration for placing a long sheet.

As illustrated in FIG. 5, however, when the job end control is executed in the first mode described above after the trailing end tray 14 is mounted to the printer main body 201A and the long sheet LP is placed on the manual feeding device 100M, the pickup roller 2 is brought into the separation state. Then, the remaining long sheet LP, which has been pressed against the manual feed tray 7 by the pickup roller 2, is released. Hence, the press-in force of the long sheet LP is undesirably exerted on the separation nip 34. When a subsequent print job is started in this state, the long sheet LP, which has been pressed into the separation nip 34, cannot be conveyed, which may result in occurrence of a conveyance failure such as a jam. Therefore, in the first embodiment, the second mode different from the first mode is provided.

[Second Mode]

Figure 7:
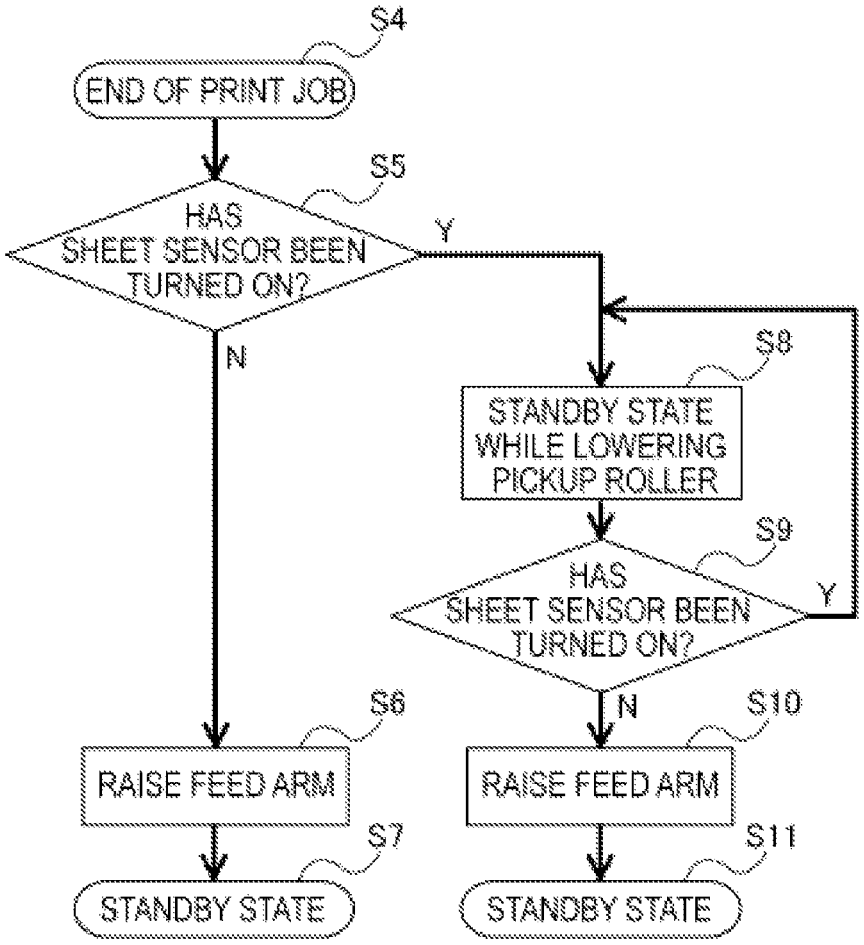
FIG. 7 is a flowchart for illustrating the job end control executed in a second mode.

FIG. 7 is a flowchart for illustrating the job end control in the second mode. In the flowchart of FIG. 7 and the following description, "Y" represents YES and "N" represents NO. When the print job ends (Step S4), the controller 9 determines whether or not the sheet sensor 11 has been turned on (Step S5). When the sheet sensor 11 is in an off-state (N in Step S5), the controller 9 raises the feed arm 5 so that the pickup roller 2 is brought into the separation state as in the first mode (Step S6). Then, the controller 9 is brought into the standby state (Step S7).

Meanwhile, when the sheet sensor 11 has been turned on (Y in Step S5), the controller 9 controls the feed arm 5 so that the pickup roller 2 maintains the contact state (Step S8). Then, the controller 9 determines again whether or not the sheet sensor 11 has been turned on (Step S9). When the sheet sensor 11 has been turned on (Y in Step S9), the processing performed by the controller 9 returns to Step S8. When the sheet sensor 11 is in the off state (N in Step S9), the controller 9 raises the feed arm 5 so that the pickup roller 2 is brought into the separation state (Step S10). Then, the controller 9 is brought into the standby state (Step S11).

Specifically, as long as the sheet remains on the manual feed tray 7, the pickup roller 2 is held in the contact state to regulate the displacement of the long sheet LP on the manual feed tray 7. Therefore, the press-in force of the long sheet LP is prevented from being intensely exerted on the separation nip 34. Thus, the occurrence of the feeding failure can be prevented in a subsequent print job. When the subsequent print job is input without removing the sheet on the manual feed tray 7, the pickup roller 2 is started to be rotated while being maintained in the contact state.

Further, after the user removes the sheet placed on the manual feed tray 7 to turn off the sheet sensor 11 under the state in which the pickup roller 2 is in the contact state to be held in contact with the sheet on the manual feed tray 7, the pickup roller 2 is brought into the separation state. In particular, the detection flag 11*a* (see FIG. 2) is provided to the downstream end portion of the manual feed tray 7 in the sheet feed direction. Therefore, when the user merely pulls out the long sheet LP from the manual feed tray 7 by a small amount, the sheet sensor 11 is turned off. Ease in placement of the sheet is not significantly lost by the above-mentioned operation.

In this embodiment, either of the first mode and the second mode can be selected on the control panel 10. Thus, after mounting the trailing end tray 14 to the printer main body 201A, the user operates the control panel 10 to select the second mode. In this manner, the controller 9 executes the control in the second mode. The controller 9 may be configured to execute the control in the first mode when the trailing end tray 14 is in the non-mounted state and execute the control in the second mode when the trailing end tray 14 is in the mounted state in accordance with a result of the detection by the trailing end tray sensor 24.

As described above, the controller 9 of the first embodiment can select the first mode when the long sheet LP is not placed on the manual feed tray 7 and select the second mode when the long sheet LP is placed on the manual feed tray 7. Through selection of the second mode, the pickup roller 2 is maintained in the contact state when the long sheet LP remains on the manual feed tray 7 after the start of the job end control. As a result, the press-in force of the long sheet LP is prevented from being intensely exerted on the separation nip 34. Thus, the occurrence of the feeding failure can be prevented in the subsequent print job.

Second Embodiment

Next, a second embodiment will be described. In the second embodiment, the job end control in the second mode according to the first embodiment is modified. An illustration is therefore omitted for the same configurations as those of the first embodiment, or the same configurations are denoted by the same reference symbols in the drawings for description.

Figure 8:
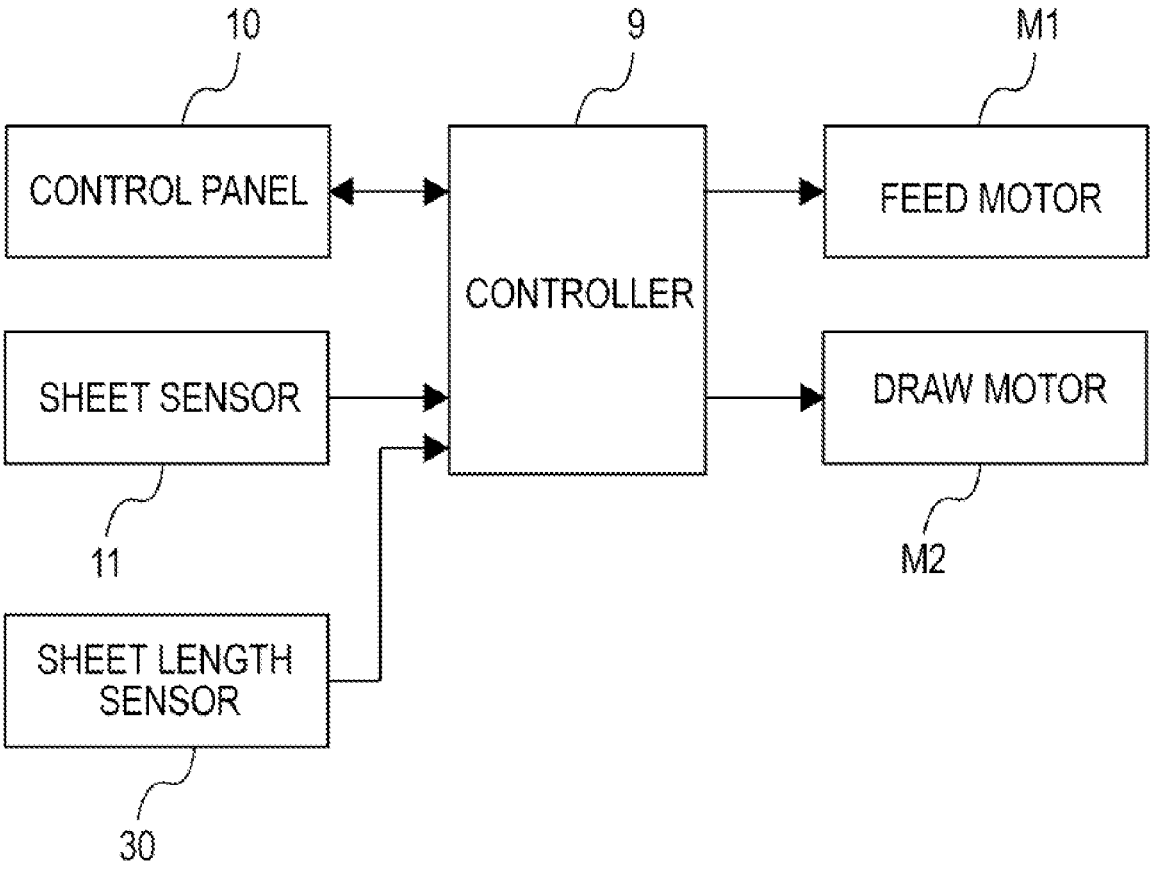
FIG. 8 is a control block diagram according to a second embodiment.

Either one of the first mode and the second mode is selected in advance before the start of the print job in the first embodiment. However, in the second embodiment, one of the first mode and the second mode is determined in accordance with a length of the sheet conveyed during the print job. Therefore, in the second embodiment, as illustrated in FIG. 8, a sheet length sensor 30 is connected to the input side of the controller 9. The sheet length sensor 30 serving as a sheet length detector includes a flag member and a photosensor, and is provided in a sheet conveyance path in the printer 201. The flag member is pressed by, for example, the sheet. The photosensor is configured to output a detection signal in accordance with a position of the flag member. A length of the sheet to be conveyed in the sheet feed direction (hereinafter referred to as "sheet length") is detected by the sheet length sensor 30.

Figure 9:
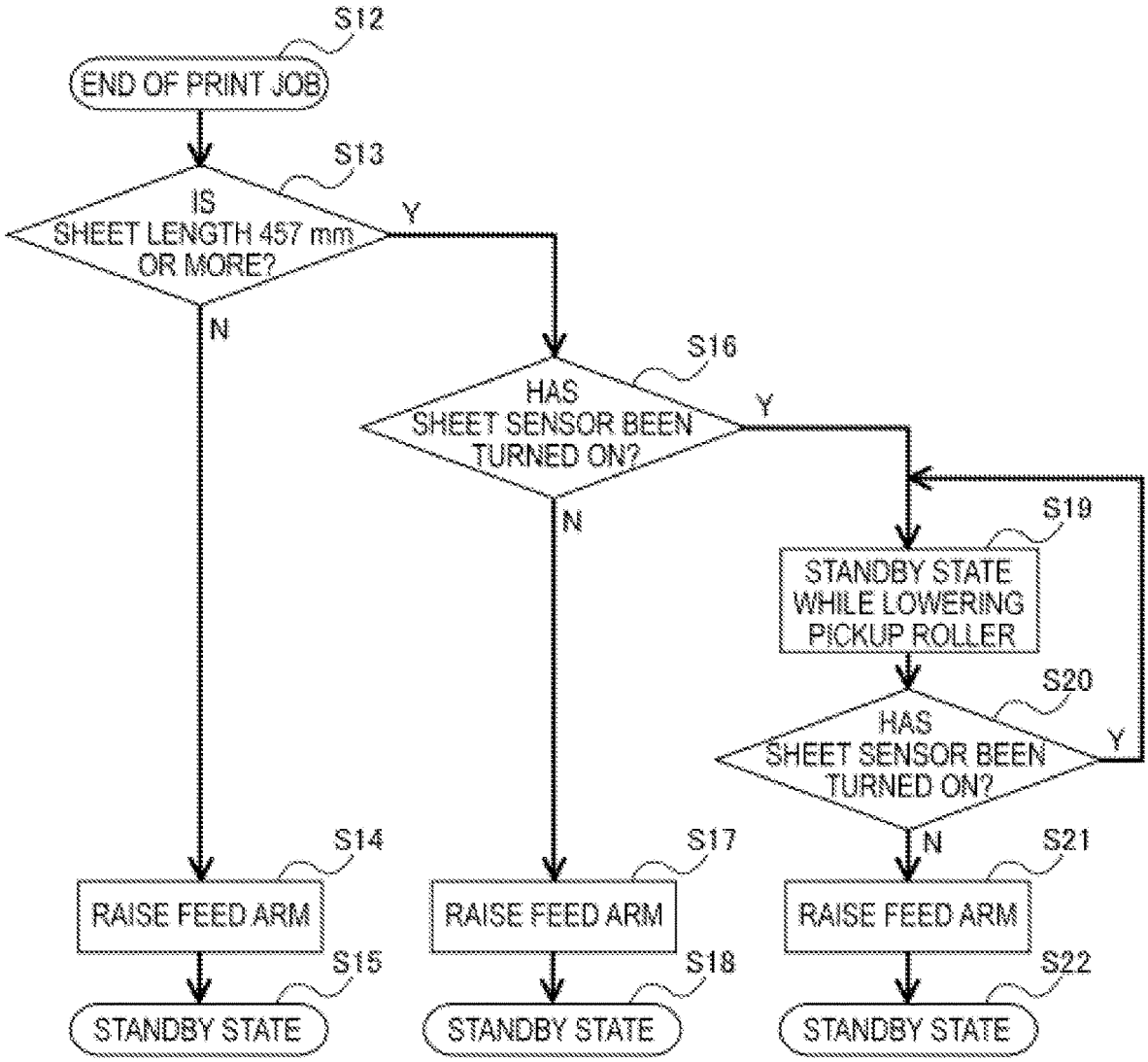
FIG. 9 is a flowchart for illustrating job end control according to the second embodiment.

FIG. 9 is a flowchart for illustrating job end control in the second mode according to the second embodiment. After the print job ends (Step S12), the controller 9 determines whether the sheet length of the sheet conveyed during the print job is 457 mm (18 inches) or more based on a result of the detection by the sheet length sensor 30 (Step S13). Although the sheet having the sheet length of 457 mm (18 inches) or more is defined as the long sheet in the second embodiment, the definition of the long sheet is not limited thereto.

When the sheet length is smaller than 457 mm (N in Step S13), the controller 9 raises the feed arm 5 so as to bring the pickup roller 2 into the separation state as in the first mode described above (Step S14). Then, the controller 9 is brought into the standby state (Step S15). When the sheet length is equal to or larger than 457 mm (Yin Step S13), the controller 9 performs processing in Step S16 and subsequent steps. The processing in Step S16 to Step S22 is the same as the processing in Step S5 to Step S11 illustrated in FIG. 7 in the first embodiment, and therefore the description thereof is herein omitted.

Specifically, in the second embodiment, the controller 9 executes the job end control in the first mode when it is determined that the sheet length is smaller than 457 mm which is a predetermined length in Step S13 and executes the job end control in the second mode when it is determined that the sheet length is 457 mm or more in Step S13. Therefore, the selection of the first mode or the second mode on the control panel 10 is not required. Therefore, an operation burden on the user can be reduced, thereby improving usability.

Another Embodiment

Figure 10:
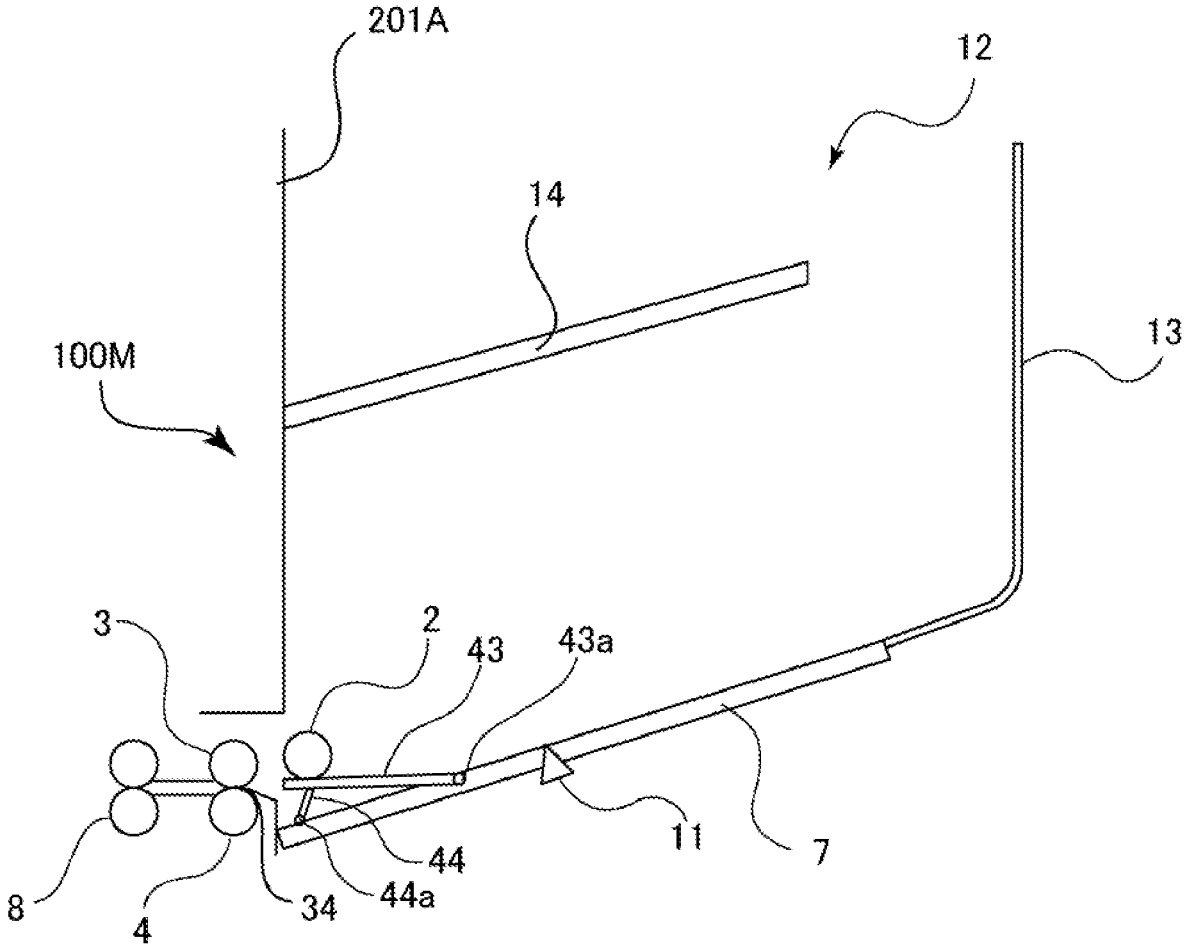
FIG. 10 is a side view for illustrating a manual feeding device according to another embodiment.

Although the pickup roller 2 is raised and lowered by the feed arm 5 to press the sheet against the manual feed tray 7 as illustrated in FIG. 5 in the first embodiment and the second embodiment described above, the configuration is not limited thereto. Specifically, as illustrated in FIG. 10, the pickup roller 2 may be configured so as not to be raiseable and lowerable without providing the feed arm 5 (see FIG. 5), and an intermediate plate 43, which is pivotable, may be provided to the manual feed tray 7. The intermediate plate 43 forms a part of the tray unit 12.

The intermediate plate 43 is supported on the manual feed tray 7 so as to be pivotable about a pivot shaft 43*a*, and is raised and lowered by being pressed by a lift arm 44 serving as a moving portion pivotable about a pivot shaft 44*a*. Then, when the intermediate plate 43 is raised to bring the sheet placed on the intermediate plate 43 into contact with the pickup roller 2, the pickup roller 2 is brought into the contact state. Further, when the intermediate plate 43 is lowered to separate the sheet placed on the intermediate plate 43 from the pickup roller 2, the pickup roller 2 is brought into the separation state. Further, without raising and lowering the intermediate plate 43 by the lift arm 44, a drive force of a drive source may be directly input to the pivot shaft 43*a* of the intermediate plate 43 so as to raise and lower the intermediate plate 43.

For the job end control, the pickup roller 2 is suitably brought into the separation state by replacing the raising of the feed arm 5 (pickup roller 2) by the lowering of the intermediate plate 43 in the flowcharts of FIG. 6, FIG. 7, and FIG. 9. As described above, it is only required that one of the pickup roller 2 configured to feed the sheet and the intermediate plate 43 (or the manual feed tray 7) on which the sheets are stacked be moved relative to the other of the intermediate plate 43 (or the manual feed tray 7) to bring the pickup roller 2 into the contact state or the separation state. In this manner, the same effects as those of the first embodiment and the second embodiment described above can be obtained.

Although the job end control is performed in the first mode or the second mode after the end of the print job in all the embodiments described above, the job end control is not limited thereto. Specifically, the job end control may be performed any time after the end of feeding of the final sheet in the print job as the sheet feed job. For example, the above-mentioned job end control may be performed after the end of feeding of the final sheet in the print job and before delivery of the final sheet to the delivery tray 230.

Further, although the job end control can be executed in both the first mode and the second mode in all the embodiments described above, the job end control may be executed only in the second mode. Further, the sheet sensor 11 may be provided not only in the manual feed tray 7 but also in the intermediate guide 13 or the trailing end tray 14, specifically, at any location in the tray unit 12. Further, the sheet sensor 11 may be a non-contact type sensor and may be provided at a location different from the tray unit 12. Specifically, the arrangement and the configuration of the sheet sensor 11 are not limited as long as the sheet sensor 11 can detect the sheets stacked in the tray unit 12.

Although the electrophotographic printer 201 is described in all the embodiments described above, the present invention is not limited thereto. For example, the present invention is also applicable to an ink jet image forming apparatus including a nozzle configured to discharge an ink liquid to form an image on the sheet. Further, the present invention is also applicable to a high-capacity stacker and other devices, which do not include the image forming portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-164718, filed Aug. 29, 2017, which is hereby incorporated by reference herein in its entirety.

What is claimed is:

1. A sheet feeding apparatus, comprising:

a stacking portion on which sheets are stacked;

a feeding portion configured to feed the sheets stacked on the stacking portion;

a separation portion configured to separate one by one the sheets fed by the feeding portion;

a sheet detector configured to detect the sheets stacked on the stacking portion;

a moving portion configured to move one of the feeding portion and the stacking portion relative to the other of the feeding portion and the stacking portion so as to bring the feeding portion into a contact state in which the feeding portion is in contact with an uppermost sheet of the sheets stacked on the stacking portion and a separation state in which the feeding portion is separated from the sheets stacked on the stacking portion; and a controller configured to control the moving portion so as to bring the feeding portion into the contact state at a time of start of a sheet feed job for feeding the sheets, wherein the controller is configured to execute control in a first mode in which the controller controls the moving portion so as to bring the feeding portion into the separation state regardless of whether the sheet detector detects a sheet after end of feeding of a final sheet in the sheet feed job, and execute control in a second mode in which the controller controls the moving portion so as to maintain the feeding portion in the contact state when the sheet detector detects a sheet after the end of feeding of the final sheet in the sheet feed job.

2. A sheet feeding apparatus according to claim 1, wherein the controller controls the moving portion so as to bring the feeding portion into the separation state when the sheet detector no longer detects a sheet in the second mode.

3. A sheet feeding apparatus according to claim 1, wherein the stacking portion comprises a first tray on which the sheets are stacked, a second tray on which trailing ends of the sheets stacked on the first tray and upwardly curved are stacked, and an intermediate guide configured to guide the sheets so that the sheets are upwardly curved between the first tray and the second tray.

4. A sheet feeding apparatus according to claim 3, further comprising:

a main body configured to support the second tray so that the second tray is mountable to and removable from the main body; and a tray detector configured to detect a mounted state in which the second tray is mounted to the main body and a non-mounted state in which the second tray is not mounted to the main body, wherein the controller is configured to execute the control in the first mode when the tray detector detects the non-mounted state, and execute the control in the second mode when the tray detector detects the mounted state.

5. A sheet feeding apparatus according to claim 1, further comprising an operating portion configured to switch a mode of the control between the first mode and the second mode.

6. A sheet feeding apparatus according to claim 1, further comprising a sheet length detector configured to detect a length of a sheet fed by the feeding portion in a sheet feed direction, wherein the controller is configured to execute the control in the first mode when the length of the sheet detected by the sheet length detector is shorter than a predetermined length, and execute the control in the second mode when the length of the sheet detected by the sheet length detector is equal to or longer than the predetermined length.

7. A sheet feeding apparatus according to claim 1, wherein the moving portion supports the feeding portion so that the feeding portion is raiseable and lowerable relative to the stacking portion, and raises and lowers the feeding portion to bring the feeding portion into the separation state and the contact state.

8. A sheet feeding apparatus according to claim 1, wherein the moving portion supports the stacking portion so that the stacking portion is raiseable and lowerable relative to the feeding portion, and raises and lowers the stacking portion to bring the feeding portion into the contact state and the separation state.

9. A sheet feeding apparatus, comprising:

a stacking portion on which sheets are stacked;

a feeding portion configured to feed the sheets stacked on the stacking portion;

a separation portion configured to separate one by one the sheets fed by the feeding portion;

a sheet detector configured to detect the sheets stacked on the stacking portion;

a moving portion configured to move one of the feeding portion and the stacking portion relative to the other of the feeding portion and the stacking portion so as to bring the feeding portion into a contact state in which the feeding portion is in contact with an uppermost sheet of the sheets stacked on the stacking portion and a separation state in which the feeding portion is separated from the sheets stacked on the stacking portion; and a controller configured to control the moving portion so as to bring the feeding portion into the contact state at a time of start of a sheet feed job for feeding the sheets, wherein the controller is configured to control the moving portion so as to maintain the feeding portion in the contact state when the sheet detector detects a sheet after end of feeding of a final sheet in the sheet feed job.

10. An image forming apparatus, comprising:

a stacking portion on which sheets are stacked;

a feeding portion configured to feed the sheets stacked on the stacking portion;

a separation portion configured to separate one by one the sheets fed by the feeding portion;

an image forming portion configured to form images on the sheets separated one by one by the separation portion;

a sheet detector configured to detect the sheets stacked on the stacking portion;

a moving portion configured to move one of the feeding portion and the stacking portion relative to the other of the feeding portion and the stacking portion so as to bring the feeding portion into a contact state in which the feeding portion is in contact with an uppermost sheet of the sheets stacked on the stacking portion and a separation state in which the feeding portion is separated from the sheets stacked on the stacking portion; and a controller configured to control the moving portion so as to bring the feeding portion into the contact state at a time of start of a sheet feed job for feeding the sheets, wherein the controller is configured to execute control in a first mode in which the controller controls the moving portion so as to bring the feeding portion into the separation state regardless of whether the sheet detector detects a sheet after end of feeding of a final sheet in the sheet feed job, and execute control in a second mode in which the controller controls the moving portion so as to maintain the feeding portion in the contact state when the sheet detector detects a sheet after the end of feeding of the final sheet in the sheet feed job.

* * * * *